United States Patent [19]

Takahashi et al.

[11] 4,029,524

[45] June 14, 1977

[54] HEAT TREATING PROCESS FOR A ROD WITHIN A FLUIDIZED BED

[75] Inventors: Eiji Takahashi, Nishinomiya; Masaru Shimizu, Kobe; Yasuhiro Oki, Kobe; Osamu Ishigami, Kobe, all of Japan

[73] Assignee: Kobe Steel Ltd., Kobe, Japan

[22] Filed: Jan. 14, 1976

[21] Appl. No.: 649,151

[30] Foreign Application Priority Data

Jan. 14, 1975 Japan ..... 50-6886

[52] U.S. Cl. ..... 148/13.1; 148/13.2; 148/14; 148/16; 148/20.3; 148/153; 148/156; 148/157

[51] Int. Cl.[2] ..... C21D 1/74

[58] Field of Search ..... 148/13.1, 14, 16, 20.3, 148/155, 156, 143, 153, 157, 13.2

[56] References Cited

UNITED STATES PATENTS 3,615,083 10/1971 Feinman et al. ..... 148/143

*Primary Examiner*—R. Dean

*Attorney, Agent, or Firm*—Oblon, Fisher, Spivak, McClelland & Maier

[57] ABSTRACT

A heat treating process for a rod by the use of a fluidized bed consisting of alumina, silicon sand, zircon sand, and the like, is disclosed for adjusting the strength of the rod due to its cooling within the fluidized bed. While prior art heat treatment processes of this type adopt an attempt to vary the temperature of the fluidized bed for varying the cooling rate of the rod, such results in the need to use costly heat-resisting apparatus for the fluidized bed and equipment associated therewith. In accordance with the heat treatment process of the present invention, a rod is introduced through means of an inlet opening into the fluidized bed, and subsequently, the rod passes through the fluidized bed in an upwardly inclined manner so as to exit from the surface of the bed. The fluidized bed in this case has a predetermined length and the rod is fed at a predetermined speed. Thus, the varying soaking times of the rod within the fluidized bed are obtained by varying the distance from the inlet to the point where the rod emerges from the surface of the fluidized bed, so as to thereby adjust the resulting strength of the rod. This process has no need to vary the temperature of the fluidized bed and yet permits the adjustment of the strength of the rod to be achieved over a wide range, with simple apparatus and operations, while retaining existing productivity.

3 Claims, 9 Drawing Figures

HEAT TREATING PROCESS FOR A ROD WITHIN A FLUIDIZED BED

BACKGROUND OF THE INVENTION

1. Field of the Invention

The present invention relates generally to a heat treating process for a rod by the use of a fluidized bed, and more particularly to a process for adjusting the strength of the rod wherein the heated rod is variably cooled within the fluidized bed.

2. Description of the Prior Art

Heretofore, heat treating processes for a rod, by the use of a fluidized bed, have been known wherein solid particles, such as, for example, alumina, silicon sand, zircon sand, and the like, are fluidized by injecting a fluid under pressure from below a layer of the solid particles, and a rod is heat treated within the medium of such a fluidized bed. In this respect, the strength of the rod may be varied by varying the cooling rate of the rod as the same passes through the fluidized bed. According to prior art heat treatment processes, the temperature of the fluidized bed is varied for varying the cooling rate of the rod, an increase in the temperature of the fluidized bed resulting in a corresponding decreases in the cooling rate of the rod, and vice versa.

Such prior art heat treatment processes, however, pose the following problems:

In case the temperature of the fluidized bed is increased to approximately 600° C, the thermal strain or deformation becomes evident within the container or tub containing the fluidized bed, which is, for example, made of steel plate, and thus, the same fails to maintain the fluidized bed in a satisfactory condition. For this reason, there arises a need to line the inner surfaces of the tub, made of steel plates, with heat-resisting bricks. The requirement for varying the temperature of the fluidized bed over a wide range extending from room temperature up to 600° C leads to the use of the aforenoted lining of heat-resisting bricks for the construction of the tube containing the fluidized bed, however, such results in an increase in the manufacturing costs and complexity in construction.

Another shortcoming of such prior art is that solid particles are discharged from the surface of the fluidized bed, and there arises a need for using a dust collector. The heat resisting problem is again confronted in this instance, however, because an increase in the temperature of the fluidized bed necessarily leads to an increase in the heat-resisting temperature of the dust collector.

Another prior art method is known which avoids the aforenoted shortcomings, that is, the temperature of the fluidized bed is maintained at a relatively low level for obviating the need of the aforenoted lining, as well as for lowering the heat-resisting temperature of the dust collector. More specifically, the length of the fluidized bed is maintained constant, while the cooling rate of the rod is varied, and to this end, the speed of the rod passing through the fluidized bed is varied. However, this attempt poses another shortcoming in that the number of rods being heat-treated varies with the speed of the rods being passed through the fluidized bed.

A solution to this problem may be that the length of the fluidized bed is varied for varying the cooling rates of the rods, however, this dictates the use of several fluidized beds having varying lengths, or a single fluidized bed whose length may be varied, the latter case particularly resulting in complex construction. In addition, a limitation is imposed upon the location of pipes or tubes, such as, for example, radiant tubes for use in increasing the temperature of the fluidized bed.

It has thus been a long-sought goal arising from industry to provide a heat treating process which avoids the aforenoted shortcomings experienced with the prior art, for adjusting the strength of rods within the particularly noted manufacturing environment.

SUMMARY OF THE INVENTION

Accordingly, it is a principal object of the present invention to provide a heat treating process for a rod, by the use of a fluidized bed, which uses a simple construction and operation, yet permits a wide range of adjustment of the strength of the rod without varying the temperature of the fluidized bed and nevertheless retains existing productivity.

Another object of the present invention is to provide a heat treating process for a rod which dispenses with the use of heat-resisting liners disposed upon the inner surface of a tub containing the fluidized bed therein, as well as permits the use of an existing dust collector.

A further object of the present invention is to provide a heat treating process for a rod by the use of a fluidized bed within which process a predetermined number of rods may be heat treated by passing the rods through the fluidized bed at a predetermined speed.

A still further object of the present invention is to provide a heat treating process for a rod by the use of a fluidized bed, which process need not vary the speed of the rod being passed through the fluidized bed, and a plurality of fluidized beds having various length need not be provided.

According to a first aspect of the present invention, there is provided a heat treating process for a rod by the use of a fluidized bed, in accordance with which the rod is introduced at a predetermined speed through means of an inlet opening into the fluidized bed, and subsequently, the rod passes through the fluidized bed in an upwardly inclined manner so as to exit from the surface of the fluidized bed, the distance from the inlet to the point where the rod emerges from the surface of the fluidized bed being varied so as to vary the cooling rate of the rod.

According to a second aspect of the present invention, the rod is introduced at a predetermined speed through means of an inlet opening into the fluidized bed, and subsequently, the rod passes through the fluidized bed in an upwardly inclined manner so as to exit from the surface of the fluidized bed along a predetermined path, the height or depth from the inlet to the surface of the fluidized bed being varied for achieving a desired soaking time of the rod.

According to a third aspect of the present invention, a rod is introduced through means of an inlet opening into the fluidized bed, and subsequently, the rod passes through the fluidized bed in an upwardly inclined manner so as to exit from the surface of the fluidized bed and move over a guide or roller means, the aforenoted roller means being moved in the horizontal direction so as to vary the distance from the inlet to the point where the rod emerges from the surface of the fluidized bed so as to thereby vary the soaking time of the rod within the fluidized bed.

The heat treating process for a rod by the use of a fluidized bed as developed according to the present invention readily varies the distance from an inlet to a point at which the rod emerges from the surface of the fluidized bed so as to thereby vary the soaking time of the rod within the fluidized bed. This permits a wide range of adjustment of the resulting strength of the rod, as well as facilitating satisfactory productivity, and the temperature of the fluidized bed is maintained at a relatively low level which permits the use of an existing tub and associated equipment, such as, for example, a dust collector, with the result that the cost of the apparatus is substantially lowered.

BRIEF DESCRIPTION OF THE DRAWINGS

Various other objects, features, and attendant advantages of the present invention will be more fully appreciated as the same becomes better understood from the following detailed description when considered in connection with the accompanying drawings, in which like reference characters designate like or corresponding parts throughout the several views, and wherein.

DETAILED DESCRIPTION OF THE ILLUSTRATED EMBODIMENTS

Figure 1A:
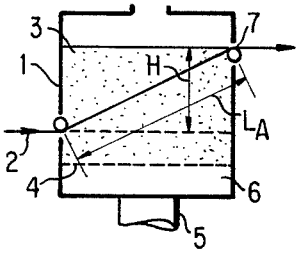
FIGS. 1A–1D and 2A–2D are schematic views illustrative of different embodiments of the heat treating process developed according to the present invention.
Figure 1B:
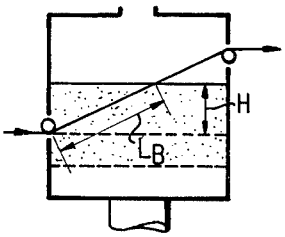
Figure 1C:
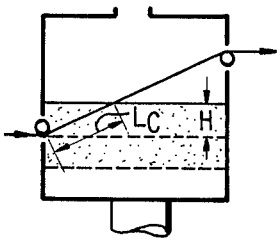
Figure 1D:
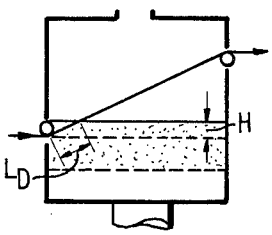
Figure 2A:
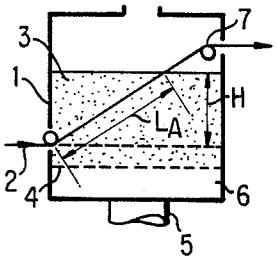
Figure 2B:
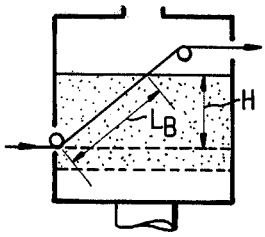
Figure 2C:
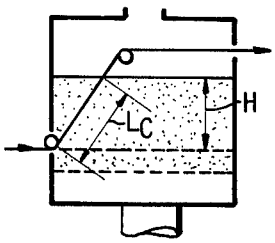
Figure 2D:
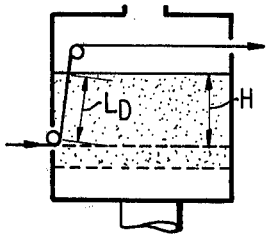

For a better understanding of the present invention, the fundamental concepts of the prior art methods for adjusting the strength of a rod, by the use of a fluidized bed, are summarized hereinbelow:

1. The soaking time of the rod is maintained constant while the temperature of the fluidized bed is varied.

2. The temperature of the fluidized bed, as well as the length thereof, are both maintained constant while the speed of the rod passing through the fluidized bed is varied so as to vary the soaking time of the rod within the fluidized bed.

3. The temperature of the fluidized bed, as well as the speed of the rod passing therethrough, are both maintained constant while the length of the fluidized bed is varied for varying the soaking time of the rod therewith.

As has been described earlier, these attempts suffer from the aforenoted shortcomings, thus failing to present satisfactory results in obtaining a wide range of adjustment of the strength of the rod.

In the light of the aforenoted attempts, the present invention is directed to providing a novel concept to cope with such noted shortcomings, within which process the temperature and the length of the fluidized bed, as well as the speed of the rod being fed therethrough, are all maintained constant, while the length of time the rod is soaked within the fluidized bed is varied, thereby varying the cooling and strength of the rod within the bed.

The present invention will now be described in greater detail with reference to the accompanying drawings which disclose the various embodiments of the present invention.

Referring now to the drawings, and more particularly to FIG. 1 thereof, a rod 2, to be subjected to heat treatment, is introduced, at a predetermined speed through an inlet opening into a fluidized bed 3, and subsequently, the rod is conveyed through the fluidized bed in an upwardly inclined manner so as to exit from the surface of the fluidized bed 3 along a predetermined path, the depth or height H extending from the inlet level or plane to the level or plane which includes the point where the rod emerges from the surface of the fluidized bed being varied for the purpose of varying the soaking time of the rod 2.

More particularly, air is fed under pressure through an air input port 5 provided within the bottom portion of a tub or furnace 1 containing the fluidized bed 3 therein so as to fluidized the solid particles contained within the tub 1 and thereby provide a fluidized bed 3. Commensurate with the strength required for the steel rod to be heat-treated, the height H from the plane of the inlet opening into the fluidized bed to the surface thereof is varied, as shown within FIGS. 1A, 1B, 1C, and 1D, while the rod is introduced through the inlet opening into the tub 1 and is subsequently conveyed through the fluidized bed in the upwardly inclined manner so as to exit from the surface of the bed, the soaking time of the rod 2 within the fluidized bed 3, that is, the time during which the rod 2 maintains contact with the solid particles thereof, being appropriately varied.

As can be seen from the Figure, the distance from the inlet to the point where the rod 2 emerges from the surface of the fluidized bed is varied to have corresponding values of LA, LB, LC, LD, respectively, which lengths are decreased in the order of the decreasing depths corresponding to FIGS. 1A, 1B, 1C, and 1D, and consequently, due to the constant speed of the conveyed rod, the soaking time of the rod will be correspondingly decreased. Within FIG. 1(A), a distributor 4 is shown to be interposed between the fluidized bed 3 and an air chamber 6, while arrows represent the moving direction of the rod 2.

Reference is now made to another embodiment of the present invention for varying the soaking time of the rod within a fluidized bed.

FIG. 2 is illustrative of the aforenoted second embodiment, and in accordance with such, the height H from the plane of the inlet to the surface of the fluidized bed 3 is maintained constant, while the position of the path of the rod passing through the fluidized bed 3 is varied so as to thereby vary the soaking time of the rod 2 within the bed in an attempt to adjust the resulting strength of the rod. More particularly, as seen within FIG. 2, a roller or guide means 7 is disposed above the surface of the fluidized bed having the constant height or depth H, and the aforenoted roller means 7 is movable in the horizontal direction above the surface of the fluidized bed.

In this respect the rod 2 is introduced through the inlet opening into the tub 1, and is subsequently conveyed through the fluidized bed 3 in an upwardly inclined manner so as to exit from the surface of the bed and be conveyed over the roller means 7. In this manner, commensurate with the strength required for the rod, the position of the roller means 7 is shifted in the horizontal direction to the various points as shown within FIGS. 2A, 2B, 2C, and 2D, respectively, LA, LB, LC, and LD representing the lengths of the soaking paths of the rods within the fluidized bed. Since the speed of the rod being passed through the fluidized bed is maintained constant, there thus results a decrease in the length of the rod path within the fluidized bed as the means 7 is shifted from the positions corresponding to FIGS. 2A, 2B, 2C, and 2D.

The reason why the inlets within FIGS. 1 and 2 are disposed beneath the surface of the fluidized bed, and why the inlets open into the fluidized beds, is that the heat transfer coefficient of the surface of the bed is low and unstable as compared with that of the interior of the fluidized bed. For this reason, upon heat treatment of the rod, it is advantageous to introduce the rod directly into the fluidized bed which presents a uniform and high heat transfer coefficient, that is, the rod is introduced into the interior of the fluidized bed for heat treatment thereof. Similarly, the extent to which the fluidized solid particles are scattered out of the tub is minimized by positioning the outlet of the rod above the surface of the fluidized bed.

The variation in the height from the inlet level to the point where the rod emerges from the surface of the fluidized bed, or the variation of the position of the path of the rod through t2e fluidized bed, facilitates the variation in the soaking time of the rod 2 within the fluidized bed, and this, in turn, varies the cooling rate of the rod 2, and hence permits the adjustment of the resulting strength thereof.

Figure 3:
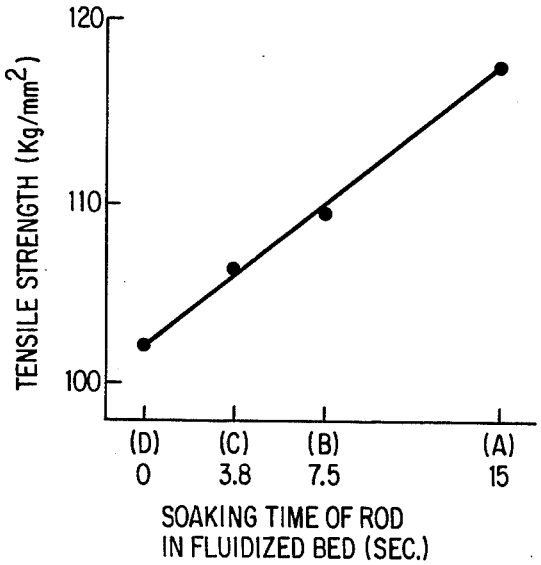
FIG. 3 is a graphical plot showing the relationship between the soaking time of a steel rod and the tensile strength thereof, derived according to the heat treatment process of the present invention.

Referring now to FIG. 3, the results of the adjustment of the strength of a steel rod, according to the aforenoted method of the present invention, are illustrated, and in this respect, a SWRH72A rod, having a diameter of 5.5 mm, was heated to a temperature of 900° C and then introduced into a fluidized bed maintained at a temperature of 300° C, while the soaking time of the rod therewithin was varied in the manner illustrated within FIG. 1. The abscissa of FIG. 3 represents the soaking time, while the ordinate of the Figure represents the tensile strength of the rod. The characters A, B, C, D within FIG. 1 substantially correspond to the characters A, B, C, D upon the abscissas of FIG. 3, and as can be seen from FIG. 3, the strength of the steel rod after heat treatment according to the present invention may be varied over a considerably wide range depending upon the soaking time thereof.

As is apparent from the foregoing description of the heat treatment process for a rod by the use of a fluidized bed, the rod to be heat treated is introduced through an inlet opening into the fluidized bed, and subsequently the rod is conveyed through the fluidized bed in an upwardly inclined manner so as to exit from the surface of the bed, while the distance from the inlet to the point at which the rod emerges from the surface of the fluidized bed is varied so as to vary the soaking time of the rod in an attempt to vary the resulting strength of the rod. The temperature of the fluidized bed may thus be maintained at a relatively low level, thereby dispensing with the use of heat resisting apparatus, while allowing the use of a simple construction for the apparatus, and in addition, the heat-resisting temperature of a dust collector may be lowered. Still further, such a simple construction allows the adjustment in the strength of the rod, presenting a substantial improvement in the productivity thereof.

Obviously, many modifications and variations of the present invention are possible in light of the above teachings. It is to be understood therefore that within the scope of the appended claims, the present invention may be practiced otherwise than as specifically described herein.

What is claimed as new and desired to be secured by Letters Patent of the United States is:

1. A heat treating process for a rod by the use of a fluidized bed maintained at a constant temperature and having a constant length and which is composed of solid particles suspended by means of a pressurized gas, comprising the steps of:

introducing a heated rod at a predetermined temperature and at a constant rate of speed through an inlet opening into said fluidized bed so as to travel therethrough for heat treatment;

passing said rod through said fluidized bed in an upwardly inclined manner so as to exit from the surface of said fluidized bed; and adjusting the resulting tensile strength of said rod by varying the soaking time of said rod within said fluidized bed as a result of varying the distance from said inlet to the point at which said rod emerges from the surface of said fluidized bed.

2. A heat treating process as defined within claim 1, wherein:

the distance from said inlet to said point at which said rod emerges from the surface of said fluidized bed is varied by varying the height or depth of said fluidized bed from said inlet to the surface of said fluidized bed while the path of said rod within said bed is maintained constant.

3. A heat treating process as defined within claim 1, wherein:

the distance from said inlet to said point at which said rod emerges from the surface of said fluidized bed is varied by shifting, in the horizontal direction, a roller means which is disposed above the surface of said fluidized bed so as to guide said rod, while the height or depth of said bed, from said inlet to the surface of said fluidized bed is maintained constant.

* * * * *